US006709018B2

(12) United States Patent
Phillips

(10) Patent No.: US 6,709,018 B2
(45) Date of Patent: Mar. 23, 2004

(54) SECURITY ENVELOPE DETECTABLE FOR FOREIGN SUBSTANCES

(75) Inventor: George K. Phillips, Paso Robles, CA (US)

(73) Assignee: Verify First Technologies, Inc., Paso Robles, CA (US)

( * ) Notice: Subject to any disclaimer, the term of this patent is extended or adjusted under 35 U.S.C. 154(b) by 0 days.

(21) Appl. No.: 10/004,184

(22) Filed: Oct. 31, 2001

(65) Prior Publication Data

US 2003/0080550 A1 May 1, 2003

(51) Int. Cl.[7] ..... B42D 15/00

(52) U.S. Cl. ..... 283/116; 229/68.1; 229/87.06; 705/408; D19/3

(58) Field of Search ..... 229/302, 68.1, 229/71, 303, 87.06; 283/116; D19/3, 5; 705/408

(56) References Cited

U.S. PATENT DOCUMENTS

| | | | | | |
|---|---|---|---|---|---|
| 204,256 | A | * | 5/1878 | Schade et al. | 229/71 |
| 1,041,827 | A | * | 10/1912 | Mca Naughton | 229/71 |
| 1,387,717 | A | * | 8/1921 | Hogan | 229/71 |
| 2,087,879 | A | * | 7/1937 | Andrews | 229/71 |
| D141,731 | S | * | 7/1945 | Bock | D19/4 |
| D141,732 | S | * | 7/1945 | Bock | D19/4 |
| 2,681,175 | A | * | 6/1954 | David | 229/75 |
| 4,245,775 | A | * | 1/1981 | Conn | 229/71 |
| 4,597,591 | A | * | 7/1986 | Gendron et al. | 283/116 |
| 4,993,624 | A | * | 2/1991 | Schlich | 229/71 |
| 5,316,208 | A | * | 5/1994 | Petkovsek | 229/71 |
| 5,344,192 | A | | 9/1994 | Phillips | |
| D354,308 | S | * | 1/1995 | Cornwell et al. | D19/5 |
| 5,511,754 | A | * | 4/1996 | Johannsen | 248/311.2 |
| 5,607,101 | A | * | 3/1997 | Saito | 229/71 |
| 5,695,220 | A | | 12/1997 | Phillips | |
| 5,704,651 | A | | 1/1998 | Phillips | |
| 5,762,378 | A | | 6/1998 | Phillips | |
| 5,772,248 | A | | 6/1998 | Phillips | |
| 5,826,916 | A | | 10/1998 | Phillips | |
| 5,873,604 | A | | 2/1999 | Phillips | |
| 5,918,983 | A | * | 7/1999 | Palazzolo | 383/5 |
| 6,029,883 | A | * | 2/2000 | Hechinger et al. | 229/71 |
| 6,082,775 | A | | 7/2000 | Phillips | |
| 6,106,021 | A | | 8/2000 | Phillips | |
| 6,588,650 | B1 | * | 7/2003 | Polidori | 229/71 |
| 2003/0075593 | A1 | * | 4/2003 | Wood | 229/71 |
| 2003/0085261 | A1 | * | 5/2003 | Wierer et al. | 229/71 |
| 2003/0141352 | A1 | * | 7/2003 | Smith et al. | 229/71 |

FOREIGN PATENT DOCUMENTS

| | | | |
|---|---|---|---|
| FR | 0506374 | * | 8/1920 |
| FR | 2679525 | * | 1/1993 |
| WO | WO 99/48700 | * | 9/1999 |

* cited by examiner

*Primary Examiner*—Monica S. Carter
(74) *Attorney, Agent, or Firm*—Michael J. Bolan; Bingham McCutchen LLP

(57) ABSTRACT

A security envelope that allows a mail handler or recipient to inspect its contents for potentially harmful granular/powder substances without ever opening the envelope is provided. The envelope comprises a front see-through window and a rear see-through window that are registered, such that an observer of the envelope can view through the envelope to examine its contents. A security background may, in place of, or in addition to, the rear window, be provided on the inside of the envelope, such that the observer can additionally verify that the envelope was sent from a trusted source. In this case, the security background will be registered with the front window. The security background may be composed of nano-structures that appear as a standard background when viewed with the naked eye, but reveal identifying elements when viewed under magnification. These nano-structures may additionally be distorted or diffused in the present of any granular/powder substance, thereby alerting the observer of a potentially harmful substance. Additional features, such as coating the inside of the windows with the particle-attracting substance, or printing the security background with a particle attracting ink, may also be provided to increase detection of any granular/powder substance within the envelope.

73 Claims, 7 Drawing Sheets

SECURITY ENVELOPE DETECTABLE FOR FOREIGN SUBSTANCES

FIELD OF THE INVENTION

The present inventions pertain to the field of security documents, and more particularly, to secure envelopes that facilitate the detection of dangerous foreign substances contained therein.

BACKGROUND

The importance of making the mail safe from insidious persons who desire to wreak havoc on the recipients of such mail has very recently become a national security issue. Previously, mail recipients needed only to be concerned with packages that were large enough to conceal explosive devices. Because standard-sized envelopes are typically not large enough to contain such devices, a recipient of an envelope sent through the postal service need not have been concerned by the simple act of opening the envelope. In the wake of biological warfare waged upon the citizens of the United States by terrorists, and their use of the United States Postal Service (USPS) as a convenient and pervasive conduit for such warfare, it has become evident that even envelopes may contain a hidden danger. In particular, it is now conceivable, and most probable in the future, that dangerous biological agents, such as Anthrax, can be concealed in envelopes in a powder form, and spread to the unfortunate recipient of the envelope when opened.

There thus is a need to provide an envelope that can easily be inspected for dangerous foreign substances contained therein without having to open the envelope, which may otherwise expose the handler of the envelope to the dangerous foreign substance.

SUMMARY OF THE INVENTION

The present inventions are directed to envelopes that carry registered front and rear see-through windows and internal security backgrounds that allow a mail handler or recipient of a sealed envelope to inspect its contents for potentially harmful granular/powder substances without ever opening the envelope.

In accordance with a first aspect of the present inventions, a security envelope comprises a first see-through window disposed on the front of the envelope, and a second see-through window disposed on the rear of the envelope, wherein the windows are registered with each other. The entireties of the windows need not be registered and need not be the same size. Rather, only enough of the windows that allows light to pass through the envelope is needed. In one non-limiting preferred embodiment, the windows are integral and are wrapped around an edge of the envelope to form the windows on the front and back of the envelope. In another non-limiting preferred embodiment, the windows can be formed of discrete pieces of material. In any event, the windows are preferably positioned adjacent an envelope edge, so that the document or documents enclosed within the envelope do not fully obstruct light passing through the windows. Optionally, a second set of windows is disposed on the envelope, such as, e.g., near the edge opposite to where the first set of windows is positioned. In this manner, at least one of the window sets will always be unobstructed by an enclosed envelope regardless of how the document is positioned in the envelope.

The envelope may optionally comprise a particle attracting substance, such as, e.g., a tacky or electrostatic substance, disposed on the insides of either or both of the windows. In this manner, the granular/powder substance will be more apt to stick to the windows, thereby clouding them and alerting the observer of a potential risk within the envelope. The particle attracting substance can optionally be applied to selected portions of the windows, such that a latent message appears on the window when exposed to the granular/powder substance. In this manner, an additional security measure for alerting the observer of a potential risk is provided. The windows can either be clear or colored to enhance the visual appearance of the granular/powder substance.

In accordance with a second aspect of the present inventions, a security envelope comprises a see-through window disposed on one side of the envelope, and a security background disposed on the inner surface of the other side of the envelope. The entireties of the window and background need not be registered and need not be the same size. Rather, only enough of the window and background that allows the background to be inspected through the window is required. The window and background are preferably positioned adjacent an envelope edge, so that documents enclosed within the envelope do not fully obstruct the background. Optionally, another window/background set can be disposed on the envelope, such as, e.g., near the edge opposite to where the first window/background set is positioned. In this manner, at least one of the backgrounds will always be unobstructed by an enclosed envelope. Even more optionally, a second window can be disposed on the other side of the envelope and registered with the first window, such that light is transmitted through the envelope. In this case, the security background may be adjacent the second window, such that both the security background and the second window can be viewed through the first window. The first and second windows may be discrete or integral, as previously described.

As previously described, a particle attracting substance can optionally be disposed on the inner surface of the window with similar substance alerting results. Even more optionally, the security background can be printed in a particle attracting ink, such as, e.g., a tacky or electrostatic substance. The security background is preferably of a composition that indicates to the observer that the envelope was sent from a trusted source. For example, the security background can be composed of a thermally-activated latent image that appears in the presence of heat.

Alternatively, the security background can be composed of a plurality of nano-structures that appear as an integral pattern, but under magnification, appear as individual identifying elements. For example, the nano-structures can form an encrypted code, which when decrypted, reveals a predetermined and known message. Each of the nano-structures can be so small as to form a half-tone element, replacing the standard half-tone dots that are typically used in the printing process. In this case, each half-tone element can be derived from an image, such as a company logo, a picture, or message. Not only can the nano-structures indicate to the observer that the envelope was sent from a trusted source, the nano-structures can affirmatively alert the observer of the existence of a granular/powder substance, which will tend to obstruct or otherwise distort or diffuse the individual nano-structures under magnification. In this case, the nano-structures need not be formatted to indicate a trusted source of the envelope, although preferably the nano-structures have some uniqueness to them to provide additional security.

In accordance with a third aspect of the present inventions, stationery comprises an envelope and a substrate (such as, e.g., a document) for placement within the envelope, a security background disposed on the document, and a see-through window disposed on one side of the envelope. Thus, rather than disposing the security background on the envelope itself, the security background is disposed on the document, such as, e.g., on the edge of the document. The envelope and document can be of a standard size, or to alternatively, any size. The importance is that the sizes of the envelope and document, and the position of the window, are coordinated, such that when the document is inserted into the envelope, the security background on the document is registered with the window. The window and background can optionally have additional security features as previously described.

In accordance with a fourth aspect of the present inventions, a security envelope comprises a see-through window that is disposed on one side of the envelope, and a particle attracting substance (such as, e.g., a tacky or electrostatic substance) disposed on at least a portion of the inner window surface. In one non-limiting embodiment, the particle attracting substance coats an entirety of the inner window surface, and in another non-limiting embodiment, the particle attracting substance coats selected portions of the inner window surface to achieve varying effects, such as, e.g., producing a latent image or message. Optionally, another see-through window can be provided on the other side of the envelope and registered with the first window to achieve the results previously described herein.

In accordance with a fifth aspect of the present inventions, a particle attracting substance, such as, e.g., a tacky or electrostatic substance, can coat all or a portion of the inner surface of an envelope, such that any granular/powder substance sticks to the inside of the envelope, thereby preventing, or at least minimizing, the dispersal of the granular/powder substance into the air when the envelope is opened. In this manner, the risk that the mail handler or recipient will breathe the dangerous substance in upon opening the envelope is minimized. This feature can be used in combination with the other features disclosed herein, or alternatively as a stand-alone feature.

Other and further aspects and features of the invention will become apparent from the following drawings and detailed description.

BRIEF DESCRIPTION OF THE DRAWINGS

In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
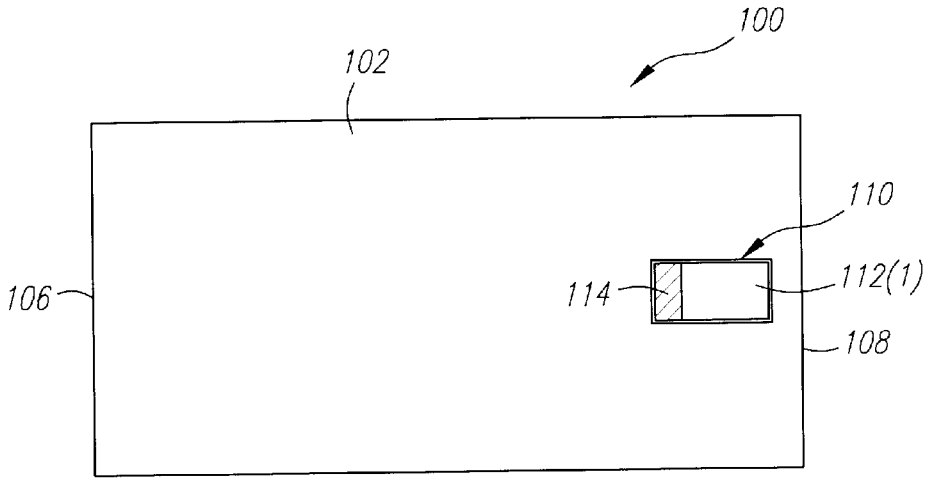
FIG. 1 is a front view of a security envelope constructed in accordance with a preferred embodiment of the present inventions, wherein a single set of registered discrete front and rear windows are provided.
Figure 2:
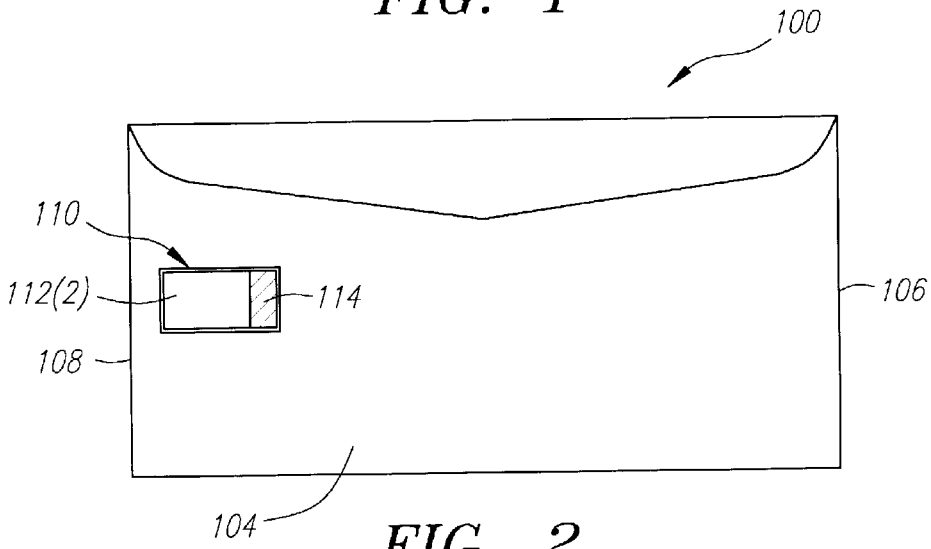
FIG. 2 is a rear view of the security envelope of FIG. 1.

FIGS. 1 and 2 depict a sealed security envelope 100 that allows a mail handler or recipient of the envelope 100 to detect the presence of a granular/powder substance contained therein without opening the envelope 100. In the illustrated embodiment, the envelope 100 is standard-sized (e.g., #10 envelope, which measures 4.12×9.5 inches and is the type usually used to carry 8.5×11 inch documents). It should be noted, however, that the envelope 100 can be any size that allows the principles taught by the present inventions to be implemented. As with typical envelopes, the envelope 100 comprises a front 102 (FIG. 1), a rear 104 (FIG. 2), and a pair of opposing edges 106 and 108.

The envelope 100 further comprises a set of see-through windows 110, including a front window 112(1) disposed on the front 102 of the envelope 100, and a rear window 112(2) disposed on the rear 104 of the envelope 100. Each window 112 is composed of an optically transparent material, such as, e.g., plastic. The windows 112 are registered with each other, such that an observer of the envelope 100 can view the rear window 112(2) when looking through the front window 112(1), or alternatively view the front window 112(1) when looking through the rear window 112(2). In the illustrated embodiment, the entireties of the windows 112 are registered with each other, i.e., the perimeters of the windows 112 are aligned with each other. It is emphasized, however, that only a portion of the front window 112(1) need be registered with a portion of the rear window 112(2) without straying from the principles taught by this invention. In any event, the transmission of light through the envelope 100 via the window set 110 facilitates and enhances visual verification of any granular/powder substance otherwise concealed within the envelope 100. It is anticipated that certain colors or combinations of clear and colors may enhance the visual identity, and thus detection, the granular/power substances.

The window set 110 is positioned adjacent one of the edges 106 and 108 of the envelope 100, and specifically the edge 108, such that a substrate, e.g., a document 114, does not totally block the passage of light through the window set 110. For example, assuming the width of the envelope 100 to be 9.5 inches, an 8.5×11 inch document 114 enclosed within the envelope 100 will effectively leave 1 inch width of the envelope 100 unoccupied by the document 114. Thus, the registered portions of the window set 110 should be positioned less than 1 inch from the edge 108 of the envelope 100. In this manner, if the document 114 totally obstructs the window-set 110 (e.g., if the edge of the document 114 abuts the edge 108 of the envelope 100), the observer need only tap the envelope 100 on the edge of the envelope 100 opposite the window set 110 (in this case, the edge 106) to force the document 114 to move away from the window set 110, thereby allowing light to pass therethrough. It should be noted that although the window set 110 is depicted in the illustrated embodiment as being positioned adjacent the edge 108, it can be suitably positioned anywhere on the envelope 100, e.g., on its bottom edge.

In the illustrated embodiment, the inner surfaces of the either or both of the windows 112 are coated with a particle attracting substance, such that any granular/powder substance adheres to the windows 112. In this manner, the visual awareness of the granular/powder substance is enhanced and/or visual clarity of the window set 110 is subdued, thereby alerting the observer of the existence of a possibly dangerous agent within the envelope 100. To prevent an insidious person from removing the particle attracting substance, the windows 112 are preferably treated with a substance that causes the windows 112 to change color in the presence of cleaning agents.

The particle attracting substance can be, e.g., a tacky or electrostatic substance that attracts, or at the least holds the granular/powder substance when it makes contact with the window set 110. In the case of a tacky substance, it is preferably not so tacky that it hinders the placement of documents within the envelope 100 (e.g., by automated machines), but tacky enough so that granular/powder substances within a reasonable particle size range adheres to the windows 112.

Figure 3:
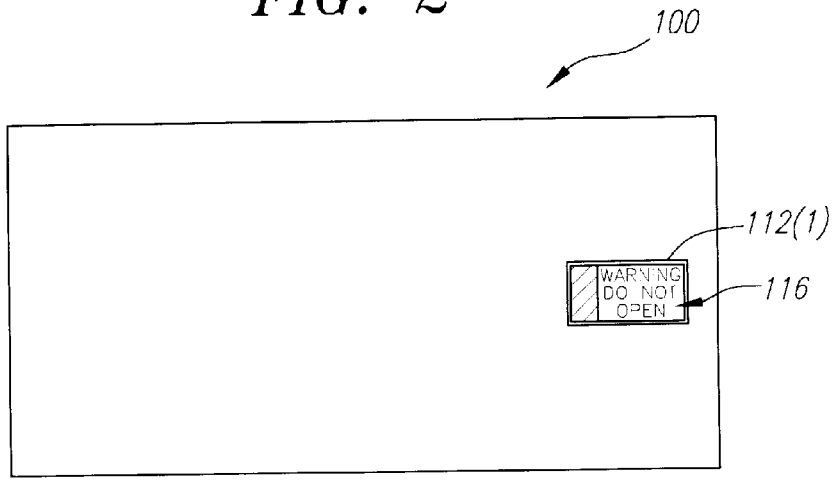
FIG. 3 is a front view of the security envelope of FIG. 1, particularly illustrating a latent image produced in a front window.

Optionally, the particle attracting substance can be applied to predetermined portions of the front window 112(1) to form a latent warning image or message that appears when a granular/powder substance adheres to the particle attracting substance. For example, FIG. 3 illustrates exemplary latent message 116, and particularly the message "Warning. Do not Opening," which appears in the front window 112(1) when it is exposed to a granular/powder substance.

To maximize the amount of granular/powder substance exposed to the window set 110, the observer, assuming that the document 114 is not totally obstructing the window set 110, preferably taps the edge of the envelope 100 adjacent the window set 110 (in this case, the edge 108, on a hard substance), while firmly grasping a portion of the envelope 100 adjacent the document 114 (such that the document 114 does not move towards and obstruct the window set 110). In this manner, any granular/powder substance contained within the envelope 100 will tend to move towards the window set 110, thereby increasing the chances that the granular/powder substance will be detected.

Figure 4:
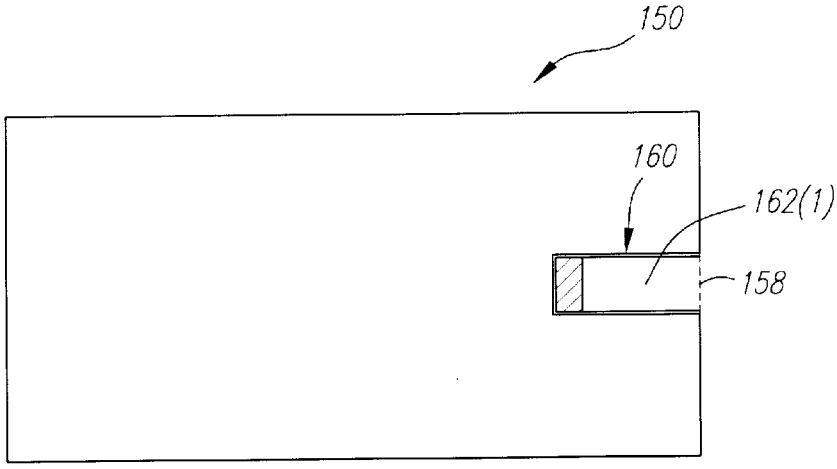
FIG. 4 is a front view of a security envelope constructed in accordance with another preferred embodiment of the present inventions, wherein a single set of registered integral front and rear windows are provided.
Figure 5:
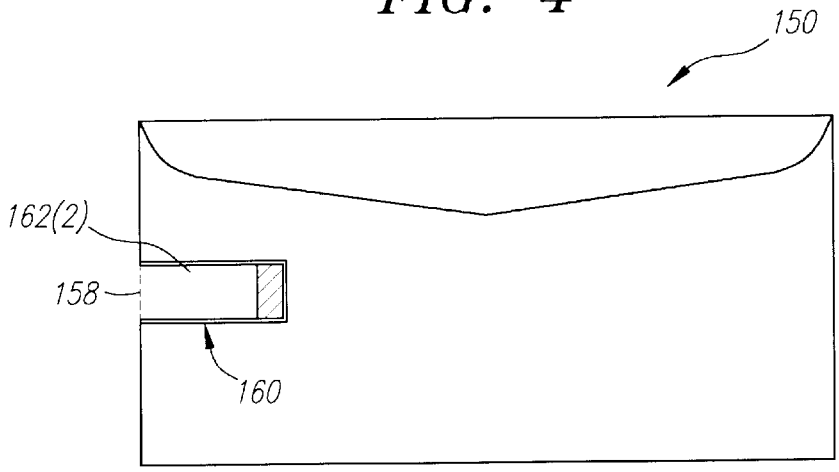
FIG. 5 is a rear view of the security envelope of FIG. 4.

As illustrated in FIGS. 1 and 2, the windows 112 are discrete in that they are formed from separate pieces of material. Alternatively, as illustrated in FIGS. 4 and 5, a secure envelope 150 comprises a window set 160, which includes integral front and rear windows 162(1) and 162(2) that are formed from a single piece of material. Thus, the front and rear windows 162(1) and 162(2) are formed by wrapping the material around an edge 158 of the envelope 150. This provides a see-through envelope that is more easily or cheaply manufactured compared to the discrete window set 110 depicted in FIGS. 1 and 2.

Figure 6:
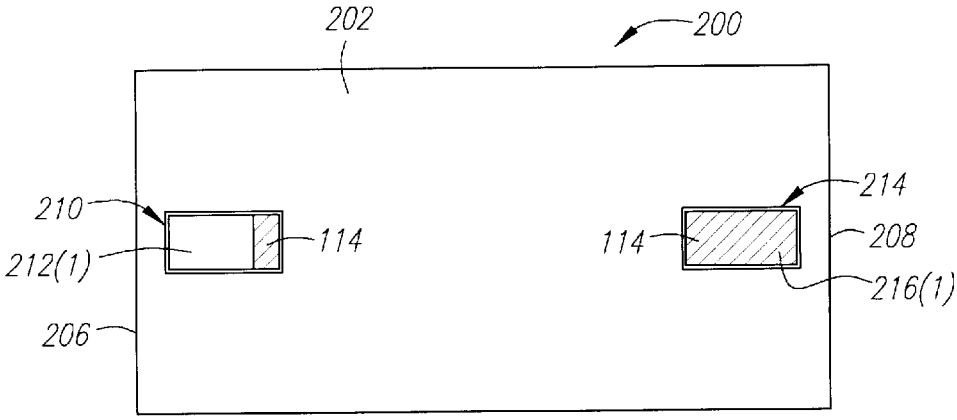
FIG. 6 is a front view of a security envelope constructed in accordance with still another preferred embodiment of the present inventions, wherein a double set of registered discrete front and rear windows are provided.
Figure 7:
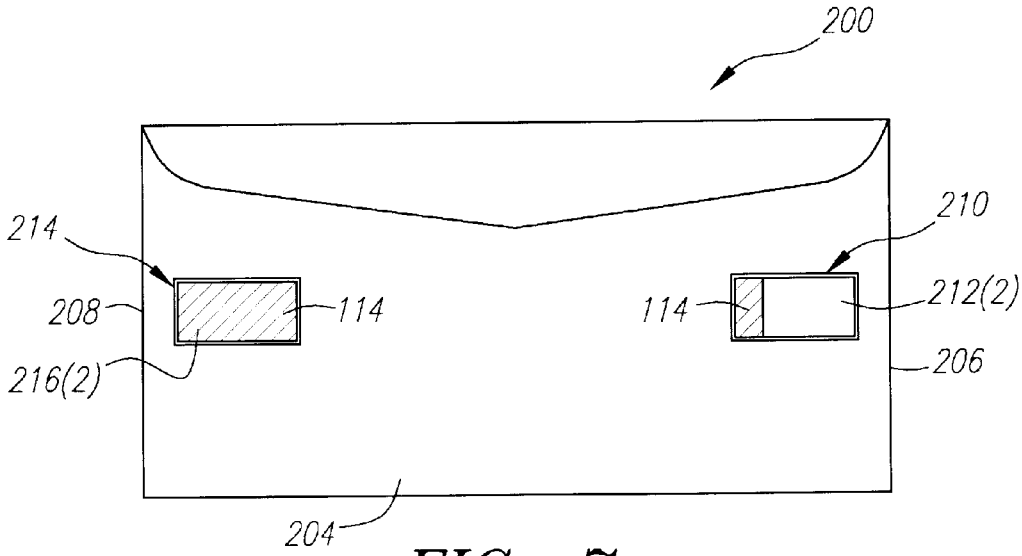
FIG. 7 is a rear view of the security envelope of FIG. 6.

FIGS. 6 and 7 depicts another sealed security envelope 200, which is similar to the previously described security envelope 100, and to the extent that the features of the envelopes 100 and 200 are similar, identical reference numbers have been used. The envelope 200 differs from the envelope 100, however, in that it carries two window sets 210 and 214 rather than a single window set. The first window set 210 includes front and rear windows 212(1) and 212(2), which are respectively disposed on the front and rear 202 and 204 of the envelope 200. Likewise, the second window set 214 includes front and rear windows 216(1) and 216(2), which are respectively disposed on the front 202 and rear 204 of the envelope 200. The provision of two window sets 210 and 214 allows visual inspection of the contents of the envelope 200 without having to adjust the position of a document 114 obstructing one of the window sets 210 and 214. That is, if the document 114 completely obstructs the window set (in the illustrated embodiment, the window set 214), the other window set (in the illustrated embodiment, the window set 210) will not be obstructed by the document 114. Thus, one of the window sets 210, 214 will always be unobstructed by the document 114. In this case, as with the previously described window set 110, the observer can tap the edge of the envelope 200 adjacent the unobstructed window set 210, while firmly grasping a portion of the envelope 200 adjacent the document 114. In this manner, any granular/powder substance contained within the envelope 200 will tend to move towards the unobstructed window set 210, thereby increasing the chances that the granular/powder substance will be detected.

Figure 8:
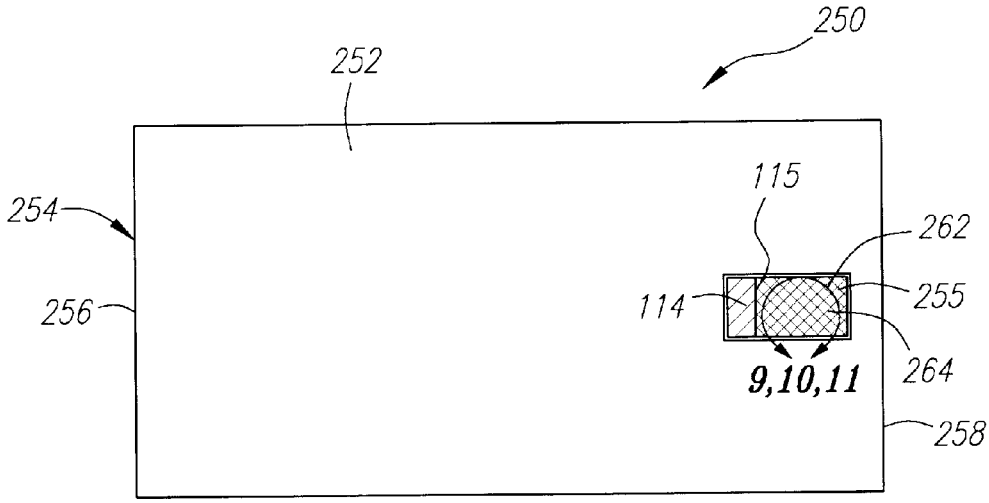
FIG. 8 is a front view of a security envelope constructed in accordance with still another preferred embodiment of the present inventions, wherein a registered window and security background are provided.

FIG. 8 depicts another sealed security envelope 250 that allows a mail handler or recipient of the envelope 250 to detect the presence of a granular/powder substance contained therein without opening the envelope 250. Like the previously described envelope 100, the envelope 250 comprises a front 252, a rear 254 with an inner surface 255, and a pair of opposing edges 256 and 258. Unlike the previously described envelope 100, however, the envelope 250 includes a front see-through window 262 disposed on its front 102, but does not include a rear see-through window. Instead, the envelope 250 comprises a security background 264 disposed on the inner rear inner surface 255 of the envelope. 250.

The front window 262 is registered with the security background 264, such that an observer of the envelope 250 can view the security background 264 when looking through the front window 262. In the illustrated embodiment, the entireties of the front window 262 and the security background 264 are registered with each other, but it should be noted, that only portions of the front window 262 and security background 264 can be registered with each other without straying from the principles taught by this invention. Optionally, the envelope 250 can have a second window/background combination similar to the double window sets illustrated in FIGS. 6 and 7 such that the observer is provided a selection of windows to view.

In the illustrated embodiment, the front window 262 is positioned, such that an edge 115 of a document 114 can be viewed. In this manner, the observer will be assured that it is the security background 264 on the envelope 250 that is presently being observed, rather than a bogus background printed on the document 114. For example, assuming the width of the envelope 250 to be 9.5 inches and the width of the document 114 to be 8.5 inches, the left portion of the front window 262 will preferably be more than 1 inch from the edge 258 of the envelope 250 to ensure that, even if the document 114 abuts the edge 256, the edge 115 of the document 114 will still appear in the front window 262. The right portion of the front window 262, however, should be positioned less than 1 inch from the edge 258 of the envelope 250 to ensure that the security background 264 is not totally obscured from view by the document 114.

In the illustrated embodiment, the security background 264 is unique to a known entity, such as a company. For example, the company can purchase security envelopes 250 that include customized security backgrounds 264 that identify it as the source that purchased the envelopes 250. The company can then distribute the security envelopes 250 to its employees for use within the company or even outside the company when sending documents from the company to outsiders. The recipient of the envelope 250, when he or she properly views the security background 264 through the front window 262, will know that the company or at least one of its employees is the source of the envelope 250, and will thus be assured that the envelope 250 does not contain a dangerous substance.

Figure 9:
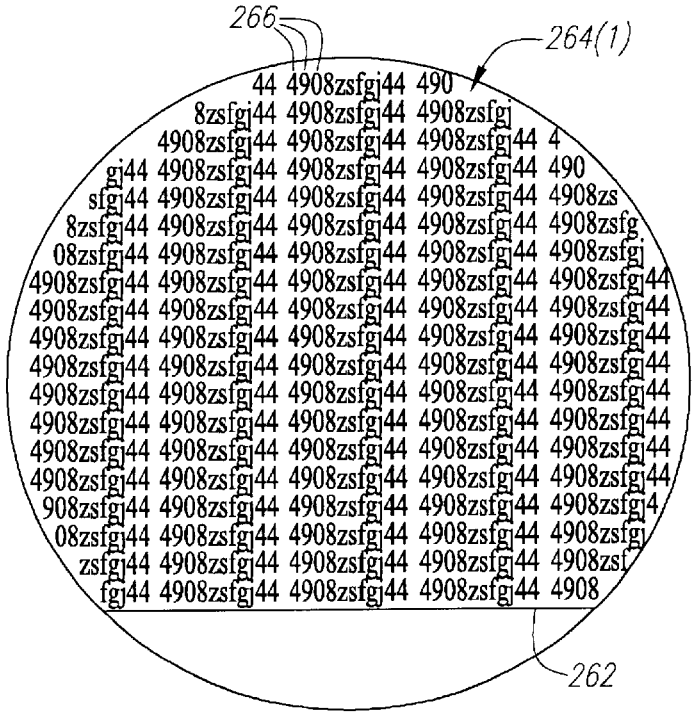
FIG. 9 is a close-up of the security background of FIG. 8, wherein nano-structures are provided.

As illustrated in FIG. 9, the security background 264(1) comprises nano-structures 266, which when viewed by the naked eye, appear as a half-tone background, but when magnified using, e.g., a magnifying loupe, appear as discrete items. In this case, the discrete items are a repeating series of alpha-numerical characters that form an encrypted code that, when decrypted, result in a predetermined and expected message. The recipient will then know that the envelope 250 was sent from a trusted source. As an additional measure, the nano-structures 266 are so small (e.g., less than 1 point in size), that their exposure to a granular/powder substance will typically obscure or diffuse the recognition of the individual nano-structures 266 when magnified. In this case, even nano-structures 266 that are not particularly unique, such as, e.g., (a non-unique pattern of polygons, circles or ovals, crosses or X's, or alpha-numerical characters) are useful in that they will alert the recipient that the envelope 250 may contain a dangerous substance if the security background 264(1) has been exposed to a granular/powder substance.

As a further measure, the ink used to print the security background 264(1) can, itself, be composed of a particle attracting substance, such as, e.g., a tacky or electrostatic substance. In this manner, any granular/powder substance concealed within the envelope 250 will tend to stick to the security background 264(1), thereby changing or diffusing its color in a manner that is detectable to the naked eye, in addition to obscuring the magnified individual nano-structures 266. Further details on the use and design of nano-structures are disclosed in U.S. patent application Ser. No. 09/621,325, entitled "Security Document With Nano-Pattern," which is fully and expressly incorporated herein by reference.

Figure 10:
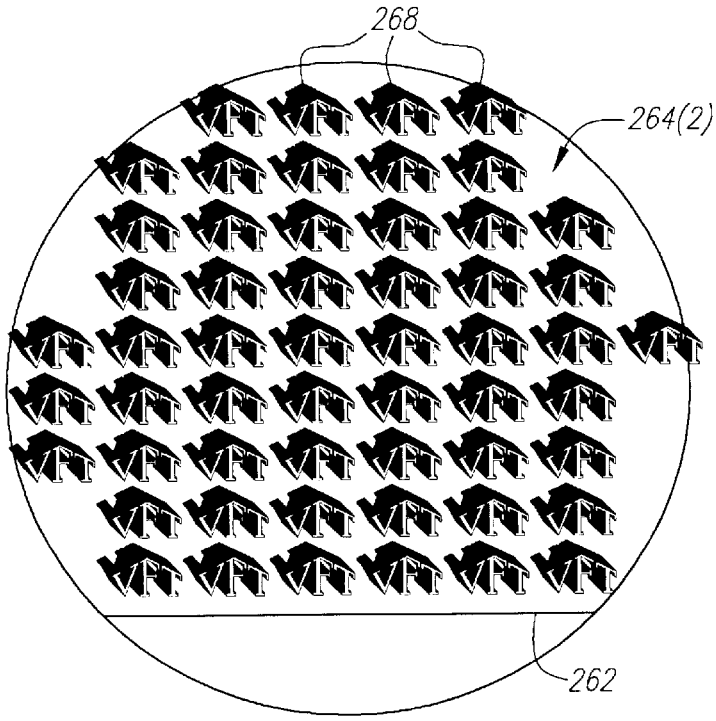
FIG. 10 is a close-up of the security background of FIG. 8, wherein image-based nano-structures are provided.
Figure 10A:
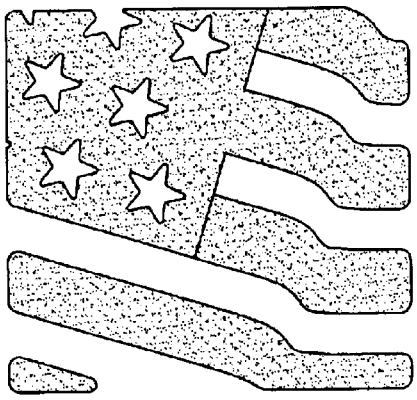
FIGS. 10*a*–10*d* are close-up views of different image-based nano-structures.
Figure 10B:
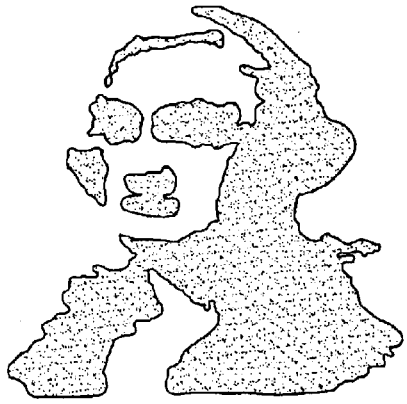
Figure 10C:
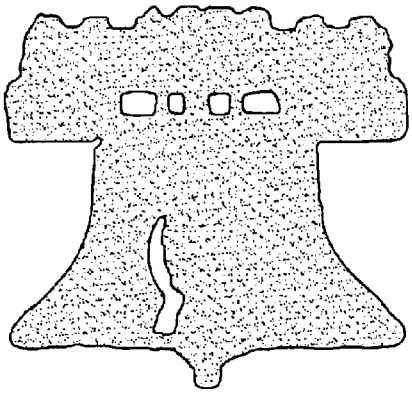
Figure 10D:
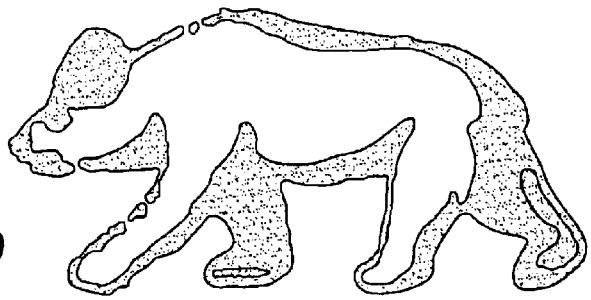

FIG. 10 illustrates an alternative background 264(2), which like the security background 264(1) illustrated in FIG. 9, comprises nano-structures 268. These nano-structures 268, however, are derived from images, such as corporate logos, photographs, pictures, or key words or phrases, that are converted into half-tone dots, which replace conventional round dots typically used in normal commercial printing. For example, each nano-structure 268 illustrated in FIG. 10 can be derived from an image of an American Flag (FIG. 10*a*), George Washington (FIG. 10*b*), Liberty Bell (FIG. 10*c*), or a California bear (FIG. 10*d*). Like the nano-structures 264 described above, the nano-structures 268 allow the recipient to verify the source of the envelope 250, and provide the additional security measure of becoming visually obscured in the presence of a granular/powder substance. The security background 264 can also be composed of a particle attracting ink with similar results. Further details on the use and design of image-derived nano-structures are disclosed in U.S. Provisional Patent Application Serial No. 60/312,170, entitled "Security Document Manufacturing Method Using Halftone Dots That Contain Microscopic Images," which is fully and expressly incorporated herein by reference.

Figure 11:
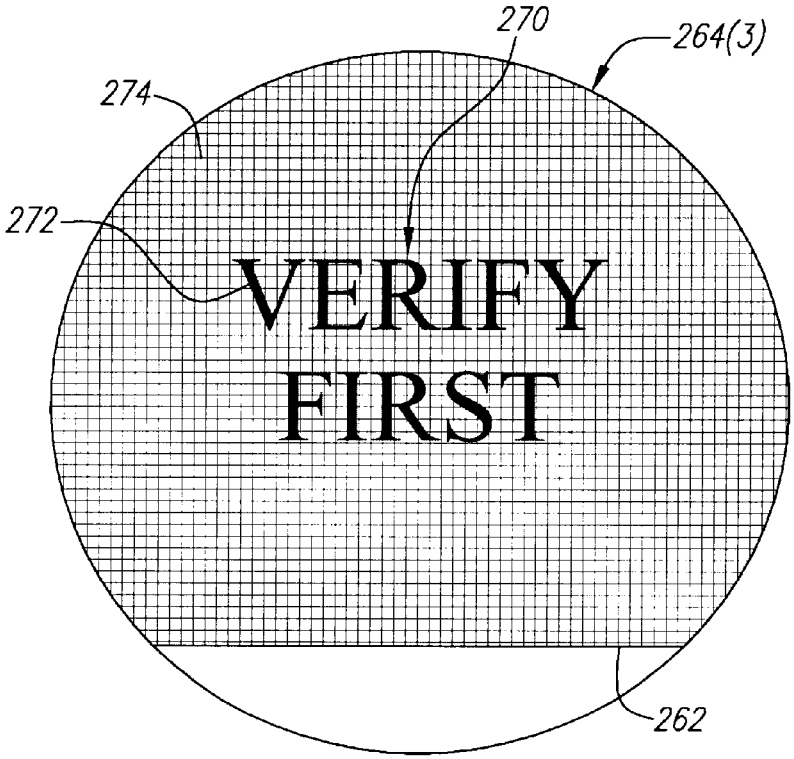
FIG. 11 is a close-up of the security background of FIG. 8, wherein a latent thermochromic image or message is provided.

FIG. 11 illustrates still another alternative background 264(3), which employs thermochromic technology. The security background 264 comprises a latent image 270 (e.g., "Verify First"), which includes a foreground 272 printed in a thermochromic ink, and a background 274 printed in a non-thermochromic ink. Under normal thermal conditions (such as, e.g., at room temperature), the colors of the foreground 272 and background 274 are matched, such that the security background 264 appears uniform to the observer. When the security background 264(3), however, is thermally activated (such as, e.g., by rubbing, or otherwise heating, the rear 254 of the envelope 250), the foreground 272 changes color, and the latent image 270 visually appears to the observer. Alternatively, the foreground 272 is composed of a non-thermochromic ink, and the background 274 is composed of a thermochromic ink to product the latent image 270. Even more alternatively, both the foreground 272 and background 274 can be composed of thermochromic ink that are differently colored when thermally activated. Further details on the use and design of thermochromic latent images are disclosed in U.S. Pat. No. 5,636,874, entitled "Temperature Sensitive Security Document," U.S. Pat. No. 5,873,604, entitled "Document Security System Having Thermo-Activated Pantograph and Validation Mark," and U.S. patent application Ser. No. 09/046,571, entitled "Variable Density Verification," all of which are fully and expressly incorporated herein by reference.

Figure 12:
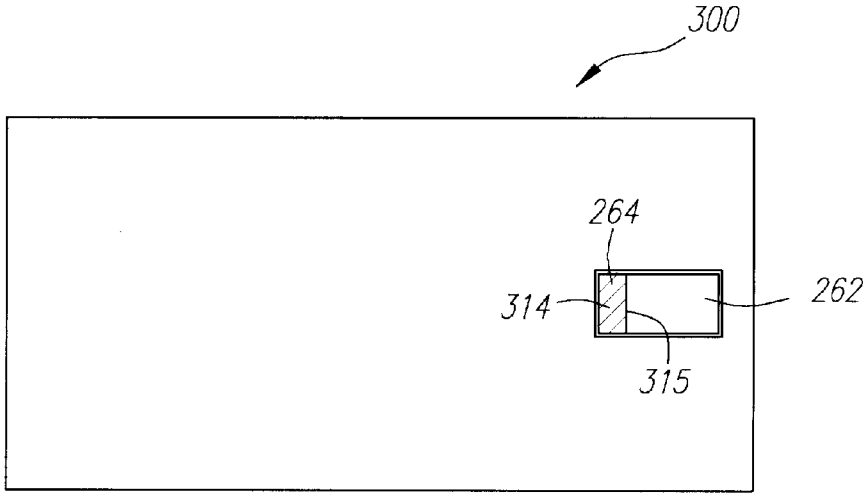
FIG. 12 is a front view of a security envelope constructed in accordance with still another preferred embodiment of the present inventions, wherein a front window and a document with a security background are provided.

FIG. 12 depicts still another sealed security envelope 300, which allows a mail handler or recipient of the envelope 300 to detect the presence of a granular/powder substance contained therein without opening the envelope 300. The envelope 300 is similar to the envelope 250 previously described with respect to FIG. 8, and to the extent that the features of both are similar, identical reference numbers have been used. The envelope 300 differs from the envelope 250, however, in that the envelope 300 itself does not include a security background. Rather, a document 314 is provided with the security background 264. In particular, the security background 264 is printed an edge 315 of the document 314, such that when the document 314 is enclosed within the envelope 300, the security background 264 will appear in the front window 262.

Like with the envelope 250 of FIG. 8, the front window 262 is positioned, such that the edge 115 of the document 114, and thus, the security background 264, can be viewed through the window 262 by an observer. Optionally, in addition to providing the security background 264 on the document 114, the same security background 264, or even a different security background, can be included on the inner rear surface of the envelope 300, similar to the envelope 250 of FIG. 8. In any event, the security background 264 can include any or all of the features previously described with respect to the security background 264 of the FIG. 8 envelope 250 with similar results.

Figure 13:
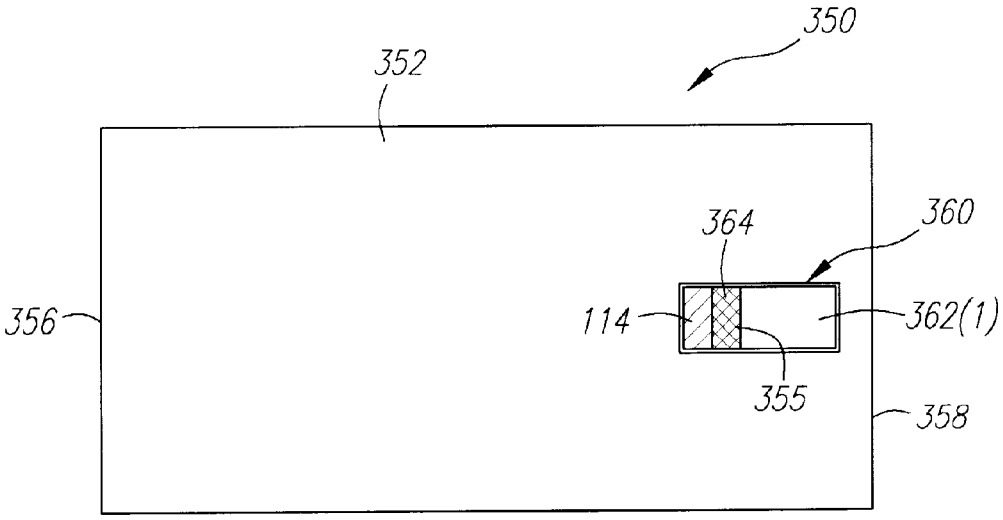
FIG. 13 is a front view of a security envelope constructed in accordance with still another preferred embodiment of the present inventions, wherein a single set of registered discrete front and rear windows and security background are provided.
Figure 14:
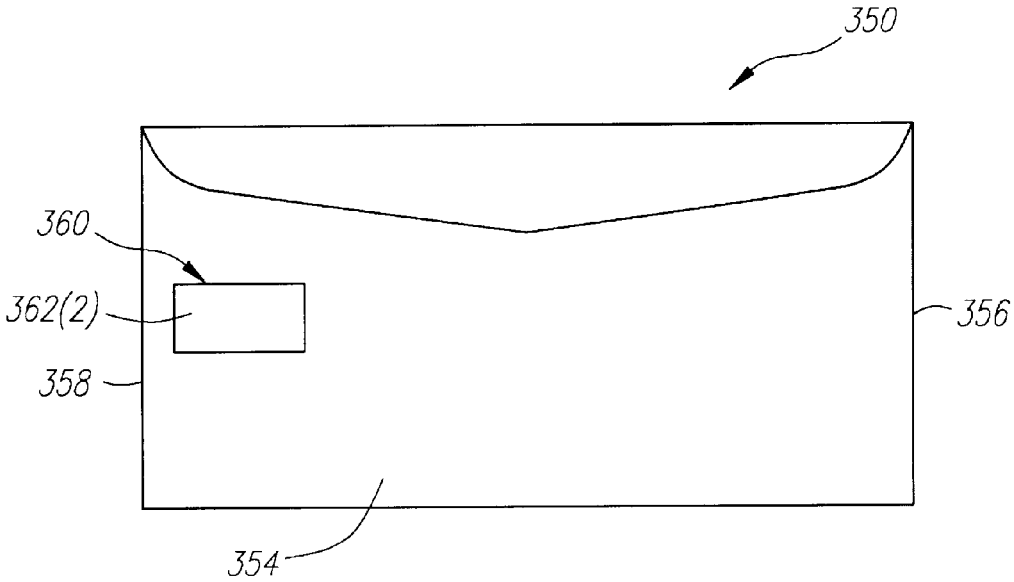
FIG. 14 is a rear view of the security envelope of FIG. 13.

FIGS. 13 and 14 depict still another sealed security envelope 350, which allows a mail handler or recipient of the envelope 300 to detect the presence of a granular/powder substance contained therein without opening the envelope 350. The envelope 350 combines the features of the envelopes 100 and 250 of FIGS. 1 and 8. To the extent that the features of both are similar, identical reference numbers have been used. Like the envelopes 100 and 250, the envelope 350 comprises a front 352, rear 354, and opposing edges 356 and 358.

The envelope 359 further comprises a set of see-through windows 360, including a front window 362(1) disposed on the front 352 of the envelope 350, and a rear window 362(2) disposed on the rear 354 of the envelope 350. Like with the window set 110 of the FIG. 1 envelope 100, the windows 352 are registered with each other, such that an observer of the envelope 350 can view the rear window 362(2) when looking through the front window 362(1), or alternatively view the front window 362(1) when looking through the rear window 362(2). The windows 362 can be coated with a particle attracting substance similar to that applied to the windows 112 of the FIG. 1 envelope 100.

The envelope 350 further comprises a security background 364 disposed on the inner rear surface 355 of the envelope 350 similar to the FIG. 8 envelope 250. The front window 362(1) is registered with the security background 364, such that an observer of the envelope 350 can view the security background 364 when looking through the front window 362(1). As illustrated, the security background 364 is adjacent the rear window 362(2), such that the size of the front window 362(1) can be minimized and both the rear window 362(2) and the security background 364 can be viewed through the front window 362(1). It is noted that the size of the front window 362(1) is larger than that of the rear window 362(2) to enable this to happen. The security background 364 can include any or all of the features previously described with respect to the security background 264 of the FIG. 8 envelope 250 with similar results.

Optionally, the envelope 350 can have a front window/back window/background combination similar to the double window sets illustrated in FIGS. 6 and 7, such that the observer is provided a selection of windows to view. Even more optionally, the security background 364 can, in addition to be being disposed in the inner rear surface 355, is also disposed on the edge of the document 114 similar to the document 314 of FIG. 12.

While embodiments and applications of this invention have been shown and described, it would be apparent, to the readers of this description, that many more modifications are possible without departing from the inventive concepts described herein. The invention, therefore, is not to be restricted beyond the scope and in the spirit of the appended claims.

What is claimed:

1. A security envelope detectable for foreign substances, comprising:

an envelope front;

an envelope rear cooperating with said envelope front to allow said security envelope to be substantially sealable;

an envelope edge;

a first see-through window disposed on said envelope front;

a second see-through window disposed on said envelope rear, wherein at least portions of said first and second windows are registered with each other, and said first and second windows are formed of a single piece of material that is wrapped around said envelope edge; and a particle attracting substance disposed on one or more of said first and second windows and exposed to an inside of said envelope.

2. The security envelope of claim 1, wherein said particle attracting substance comprises a tacky substance.

3. The security envelope of claim 1, wherein said particle attracting substance comprises an electrostatic substance.

4. The security envelope of claim 1, wherein said particle attracting substance is disposed on both of said first and second windows.

5. The security envelope of claim 1, wherein said particle attracting substance forms a latent image or message on said one or more windows.

6. The security envelope of claim 1, wherein one or more of said first and second windows are treated with a substance that changes a color of said windows when exposed to a cleaning agent.

7. A security envelope detectable for foreign substances, comprising:

a first envelope side;

a second envelope side opposite said first envelope side, said second envelope side having an inner surface;

a security background disposed on said inner surface;

a see-through window disposed on said first envelope side, wherein at least portions of said window and said security background are registered; and a particle attracting substance disposed on said window and exposed to an inside of said envelope.

8. The security envelope of claim 7, further comprising an envelope edge, wherein said window and said background are positioned adjacent said envelope edge.

9. The security envelope of claim 7, wherein said security background is configured to visually identify an entity as the source of said security envelope.

10. The security envelope of claim 7, wherein said particle attracting substance comprises a tacky substance.

11. The security envelope of claim 7, wherein said particle attracting substance comprises an electrostatic substance.

12. The security envelope of claim 7, wherein said window is treated with a substance that changes a color of said window when exposed to a cleaning agent.

13. The security envelope of claim 7, wherein said security background is printed in a particle attracting ink.

14. The security envelope of claim 13, wherein said particle attracting ink comprises a tacky substance.

15. The security envelope of claim 13, wherein said particle attracting ink comprises an electrostatic substance.

16. The security envelope of claim 17, wherein said window is colored.

17. The security envelope of claim 7, wherein said window is clear.

18. The security envelope of claim 7, wherein said window is colored and clear.

19. The security envelope of claim 7, wherein said security background comprises a thermally-activated latent image.

20. The security envelope of claim 7, wherein said security background is unique to a known entity.

21. The security envelope of claim 7, wherein said security background comprises a plurality of nano-structures.

22. The security envelope of claim 21, wherein each of said plurality of nano-structures forms a half-tone element.

23. The security envelope of claim 22, wherein said half-tone element is derived from an image.

24. The security envelope of claim 22, wherein said half-tone element comprises a company logo.

25. The security envelope of claim 22, wherein said half-tone element comprises a photograph.

26. The security envelope of claim 7, further comprising another see-through window disposed on said second envelope side, wherein at least portions of said window and said another window are registered with each other.

27. The security envelope of claim 26, wherein said security background is adjacent said second window.

28. The security envelope of claim 26, further comprising an envelope edge, wherein said first and second windows are formed of a single piece of material that is wrapped around said envelope edge.

29. The security envelope of claim 26, wherein said first and second windows are formed of discrete pieces of material.

30. The security envelope of claim 7, further comprising:

another security background disposed on said inner surface;

another see-through window disposed on said first envelope side, wherein at least portions of said another window and said another security background are registered.

31. Stationery detectable for foreign substances, comprising:

an envelope having a first envelope side;

a substrate for placement within said envelope;

a security background disposed on said substrate;

a first see-through window disposed on said first envelope side, wherein at least portions of said first window and said security background are registered with each other; and a particle attracting substance disposed on said window and exposed to an inside of said envelope.

32. The stationery of claim 31, wherein said substrate is composed of paper.

33. The stationery of claim 31, wherein said substrate measures approximately 8.5 inches ×11 inches, and said envelope measures approximately 4.12×9.5 inches.

34. The stationery of 31, wherein said security background is disposed on an edge of said substrate.

35. The stationery of claim 31, wherein said envelope has an envelope edge, and said first window is positioned adjacent said envelope edge.

36. The stationery of 31, wherein said security background is configured to visually identify an entity as the source of said security envelope.

37. The stationery of 31, wherein said particle attracting substance comprises a tacky substance.

38. The stationery of claim 31, wherein said particle attracting substance comprises an electrostatic substance.

39. The stationery of 31, wherein said window is treated with a substance that changes a color of said window when exposed to a cleaning agent.

40. The stationery of claim 31, wherein said first window is colored.

41. The stationery of 31, wherein said first window is clear.

42. The stationery of claim 31, wherein said window is colored and clear.

43. The stationery of claim 31, wherein said security background comprises a thermally-activated latent image.

44. The stationery of 31, wherein said security background is unique to a known entity.

45. The stationery of claim 31, wherein said security background comprises a plurality of nano-structures.

46. The stationery of claim 45, wherein said plurality of nano-structures forms a plurality of half-tone elements.

47. The stationery of claim 45, wherein each of said plurality of nano-structures is derived from an image.

48. The stationery of claim 45, wherein each of said plurality of nano-structures comprises a company logo.

49. The stationery of claim 31, further comprising:

a second envelope side opposite said first envelope side; and a second see-through window disposed on said second envelope side, wherein at least portions of said first and second windows are registered with each other.

50. The stationery of claim 49, wherein said security background is adjacent said second window.

51. The stationery of claim 49, wherein said envelope has an envelope edge, and said first and second windows are formed of a single piece of material that is wrapped around said envelope edge.

52. The stationery of claim 49, wherein said first and second windows are formed of discrete pieces of material.

53. The stationery of claim 49, wherein said second envelope side has an inner surface, the stationery further comprising another a security background disposed on said inner surface, wherein at least portions of said first window and said another security background are registered.

54. The stationery of claim 53, wherein said first and second security backgrounds are the same.

55. The stationery of claim 31, wherein said first envelope side comprises a front of said envelope.

56. A security envelope detectable for foreign substances, comprising:

a first envelope side;

a first see-through window disposed on said first envelope side and having an inner window surface; and a particle attracting substance coating at least a portion of said inner window surface.

57. The security envelope of claim 56, wherein said particle attracting substance coats an entirety of said inner window surface.

58. The security envelope of claim 56, wherein said particle attracting substance forms a latent image or message on said inner window surface.

59. The security envelope of claim 56, wherein said particle attracting substance comprises a tacky substance.

60. The security envelope of claim 56, wherein said particle attracting substance comprises an electrostatic substance.

61. The security envelope of claim 56, wherein said window is treated with a substance that changes a color of said window when exposed to a cleaning agent.

62. The security envelope of claim 56, wherein said first window is colored.

63. The security envelope of claim 56, wherein said first window is clear.

64. The security envelope of claim 56, wherein said first window is colored and clear.

65. The security envelope of claim 56, further comprising:

a second envelope side opposite said first envelope side; and a second see-through window disposed on said second envelope side, wherein at least portions of said first and second windows are registered with each other.

66. The security envelope of claim 65, further comprising an envelope edge, and said first and second windows are formed of a single piece of material that is wrapped around said envelope edge.

67. The security envelope of claim 65, wherein said first and second windows are formed of discrete pieces of material.

68. A security envelope detectable for foreign substances, comprising:

an envelope front;

an envelope rear;

an envelope edge;

a first see-through window disposed on said envelope front; and a second see-through window disposed on said envelope rear, wherein said first and second windows are formed of a single piece of material that is wrapped around said envelope edge; and a particle attracting substance disposed on one or more of said first and second windows and exposed to an inside of said envelope.

69. The security envelope of claim 68, wherein said particle attracting substance comprises a tacky substance.

70. The security envelope of claim 68, wherein said particle attracting substance comprises an electrostatic substance.

71. The security envelope of claim 68, wherein said particle attracting substance is disposed on both of said first and second windows.

72. The security envelope of claim 68, wherein said particle attracting substance forms a latent image or message on said one or more windows.

73. The security envelope of claim 68, wherein one or more of said first and second windows are treated with a substance that changes a color of said windows when exposed to a cleaning agent.

* * * * *